US006250625B1

(12) United States Patent
Janatka et al.

(10) Patent No.: US 6,250,625 B1
(45) Date of Patent: Jun. 26, 2001

(54) METHOD FOR SUPPLYING ENVELOPES TO AN INSERTER SYSTEM BY WAY OF MULTIPLE SUPPLY PATHS

(75) Inventors: Karel J. Janatka, Southbury, CT (US); John W. Sussmeier, Cold Spring, NY (US); William J. Wright, Killingworth, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/464,176

(22) Filed: Dec. 16, 1999

(51) Int. Cl.[7] ..... B65H 29/66

(52) U.S. Cl. ..... 271/65; 271/2; 271/303; 271/149; 271/150; 271/9.01; 271/9.12; 271/9.13; 270/58.06

(58) Field of Search ..... 271/2, 149, 150, 271/303, 9.01, 9.12, 9.13, 65; 270/58.06

(56) References Cited

U.S. PATENT DOCUMENTS 4,615,519 * 10/1986 Holodnak et al. ..... 271/122
4,817,368 * 4/1989 DePasquale et al. ..... 53/460
5,083,769 * 1/1992 Young, Jr. .
5,116,039 * 5/1992 Braen et al. ..... 271/34
5,119,954 * 6/1992 Svyatsky et al. ..... 209/584
5,464,099 * 11/1995 Stevens et al. ..... 209/3.1
5,934,666 * 8/1999 Rabindran et al. ..... 271/148
5,947,461 * 9/1999 Holbrock ..... 270/52.09
6,164,640 * 12/2000 Stengl et al. ..... 271/187

* cited by examiner

*Primary Examiner*—Robert P. Olszewski
*Assistant Examiner*—Richard Ridley
(74) *Attorney, Agent, or Firm*—Christopher J. Capelli; Michael E. Melton

(57) ABSTRACT

A method for supplying envelopes to an inserter system, including the steps of providing an envelope supply structure having an exit point, providing at least first and second supply paths from the exit point of the envelope supply structure and providing a common path from the at least first and second supply paths. Individual envelopes are fed from the envelope supply structure to a selected one of the at least first and second supply paths wherein the envelope is conveyed to a holding area in the selected supply path and from the holding area of the selected supply path it is conveyed to the common path. The envelope then travels from the common path to an envelope insertion area wherein prearranged documents are caused to be inserted into the envelope.

15 Claims, 5 Drawing Sheets

METHOD FOR SUPPLYING ENVELOPES TO AN INSERTER SYSTEM BY WAY OF MULTIPLE SUPPLY PATHS

FIELD OF THE INVENTION

The present invention relates generally to multi-station document inserting systems, which assemble batches of documents for insertion into envelopes. More particularly, the present invention is directed towards the envelope input system for providing envelopes at high count to such multi-station document inserting systems.

BACKGROUND OF THE INVENTION

Multi-station document inserting systems generally include a plurality of various stations that are configured for specific applications. Typically, such inserting systems, also known as console inserting machines, are manufactured to perform operations customized for a particular customer. Such machines are known in the art and are generally used by organizations, which produce a large volume of mailings where the content of each mail piece may vary.

For instance, inserter systems are used by organizations such as banks, insurance companies and utility companies for producing a large volume of specific mailings where the contents of each mail item are directed to a particular addressee. Additionally, other organizations, such as direct mailers, use inserts for producing a large volume of generic mailings where the contents of each mail item are substantially identical for each addressee. Examples of such inserter systems are the 8 series and 9 series inserter systems available from Pitney Bowes, Inc. of Stamford, Conn.

In many respects the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mailpiece is produced. The exact configuration of each inserter system depends upon the needs of each particular customer or installation.

For example, a typical inserter system includes a plurality of serially arranged stations including an envelope feeder, a plurality of insert feeder stations and a burster-folder station. There is a computer generated form or web feeder that feeds continuous form control documents having control coded marks printed thereon to a cutter or burster station for individually separating documents from the web. A control scanner is typically located in the cutting or bursting station for sensing the control marks on the control documents. According to the control marks, these individual documents are accumulated in an accumulating station and then folded in a folding station. Thereafter, the serially arranged insert feeder stations sequentially feed the necessary documents onto a transport deck at each insert station as the control document arrives at the respective station to form a precisely collated stack of documents which is transported to the envelope feeder-insert station where the stack is inserted into the envelope. A typical modem inserter system also includes a control system to synchronize the operation of the overall inserter system to ensure that the collations are properly assembled.

In order for such multi-station inserter systems to process a large number of mailpieces (e.g., 18,000 mailpieces an hour) it is thus required that each mailing piece consisting of mail pages is inserted in an envelope at high rates wherein throughput with reliability is always an objective. To achieve reliability it is sometimes advantageous to provide parallel paths, each path operating at a lower throughput than the desired overall throughput so that mail piece components do not change velocity so quickly as to be damaged or to jam in the mailing system.

Many mailing systems include insertion engines, which insert mail pages into an envelope (after the mail pages are folded, if necessary). In some mailing systems with an insertion engine, throughputs as high as 18,000 mail pieces per hour (five per second) are achieved. In such a mailing system, an insertion engine is provided with the envelopes of the mail pieces by an envelope transport system (and is provided with the pages of the mail pieces, to be inserted into the envelopes, by a page transport system).

The envelope transport system includes an envelope hopper (12 of FIG. 2) that must be periodically loaded with envelopes. In some mailing systems, because of various constraints, it is necessary that the envelope hopper be on the same side of the mailing system as where the operator is stationed, and of course that the envelope hopper be easily loadable. An envelope hopper typically holds about 1500 envelopes when fully loaded, and so must be replenished about every five minutes when used in a mailing system operating at a throughput of five mail pieces per second.

In some mailing system architectures, all of these requirements combine so that a layout of the envelope transport system can use a planar envelope hopper (12 of FIG. 2) feeding envelopes (11 of FIG. 2) on edge. In such a situation, what is needed is a design for an envelope transport system that allows using such a feeder, and that provides envelopes at the required high throughput, but that keeps changes in the envelope velocity to within acceptable limits.

SUMMARY OF THE INVENTION

The present invention provides a method for supplying envelopes to an inserter system including the steps of providing an envelope supply structure having an exit point and stacking a plurality of envelopes in the envelope supply structure such that each envelope is stacked on its flap fold edge portion. First and second supply paths are provided from the exit point of the envelope supply structure and a diverting gate is provided intermediate the exit point of the envelope supply structure and entry points to the first and second supply paths, the diverting gate being movable between first and second positions. A common path is provided from the at least first and second supply paths to an envelope insertion area where documents are caused to be inserted into the envelope.

In operation, individual envelopes are caused to be fed from the envelope supply structure to a selected one of the at least first and second supply wherein the diverting gate is positioned in one of its first and second positions so as to selectively cause an individual envelope to convey from the exit point of the envelope supply structure to the selected supply path. The envelope is next conveyed to a holding area in the selected supply path whereafter the envelope is conveyed from the holding area of the selected supply path to the common path. The envelope is then conveyed from the common path to an envelope insertion area wherein prearranged documents are caused to be inserted into the envelope.

BRIEF DESCRIPTION OF THE DRAWINGS

The above and other objects and advantages of the present invention will become more readily apparent upon consideration of the following detailed description, taken in conjunction with accompanying drawings, in which like reference characters refer to like parts throughout the drawings and in which.

DETAILED DESCRIPTION

Figure 1:
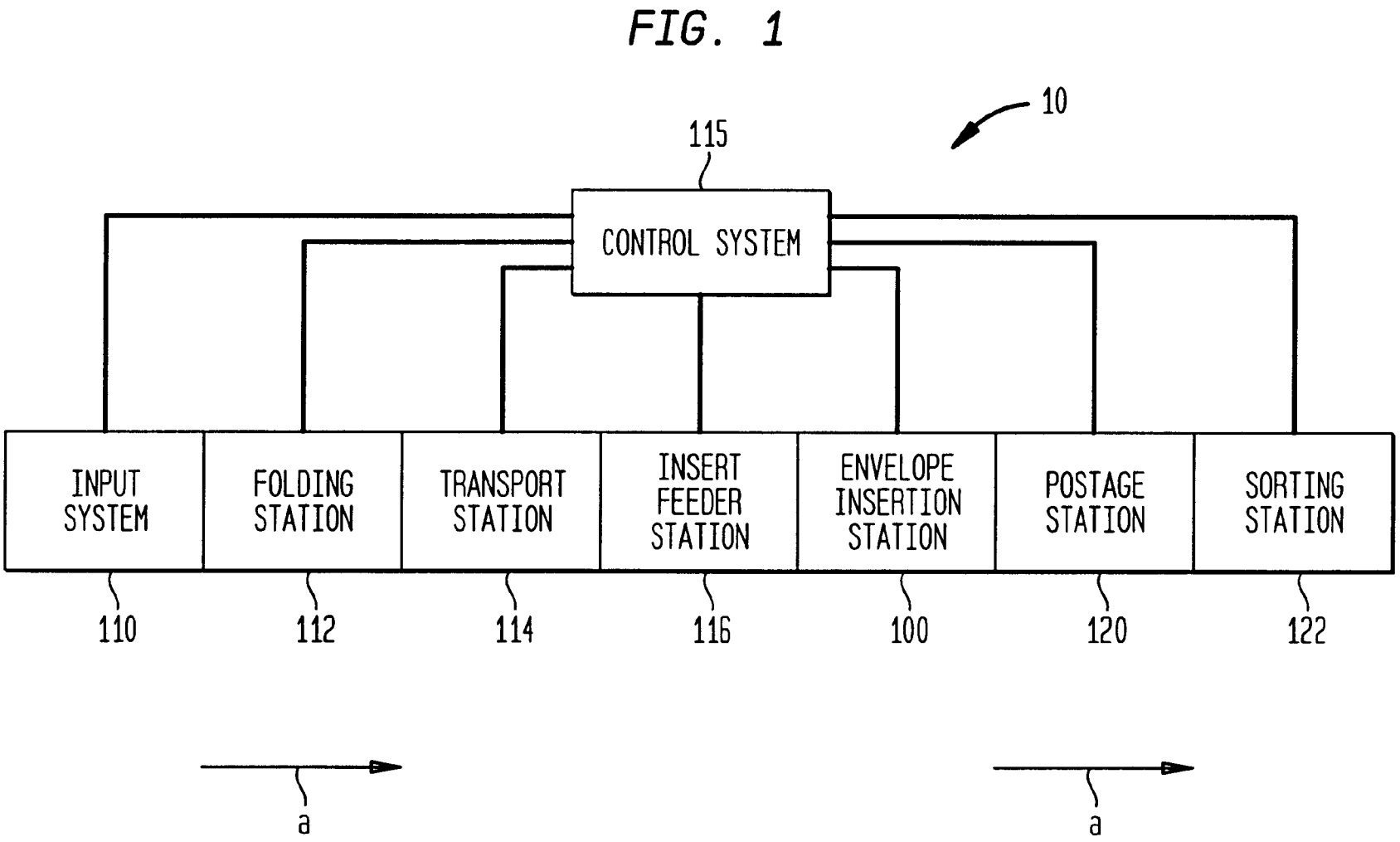
FIG. 1 is a block diagram schematic of a document inserting system in which the present invention envelope transport system is incorporated.
Figure 2:
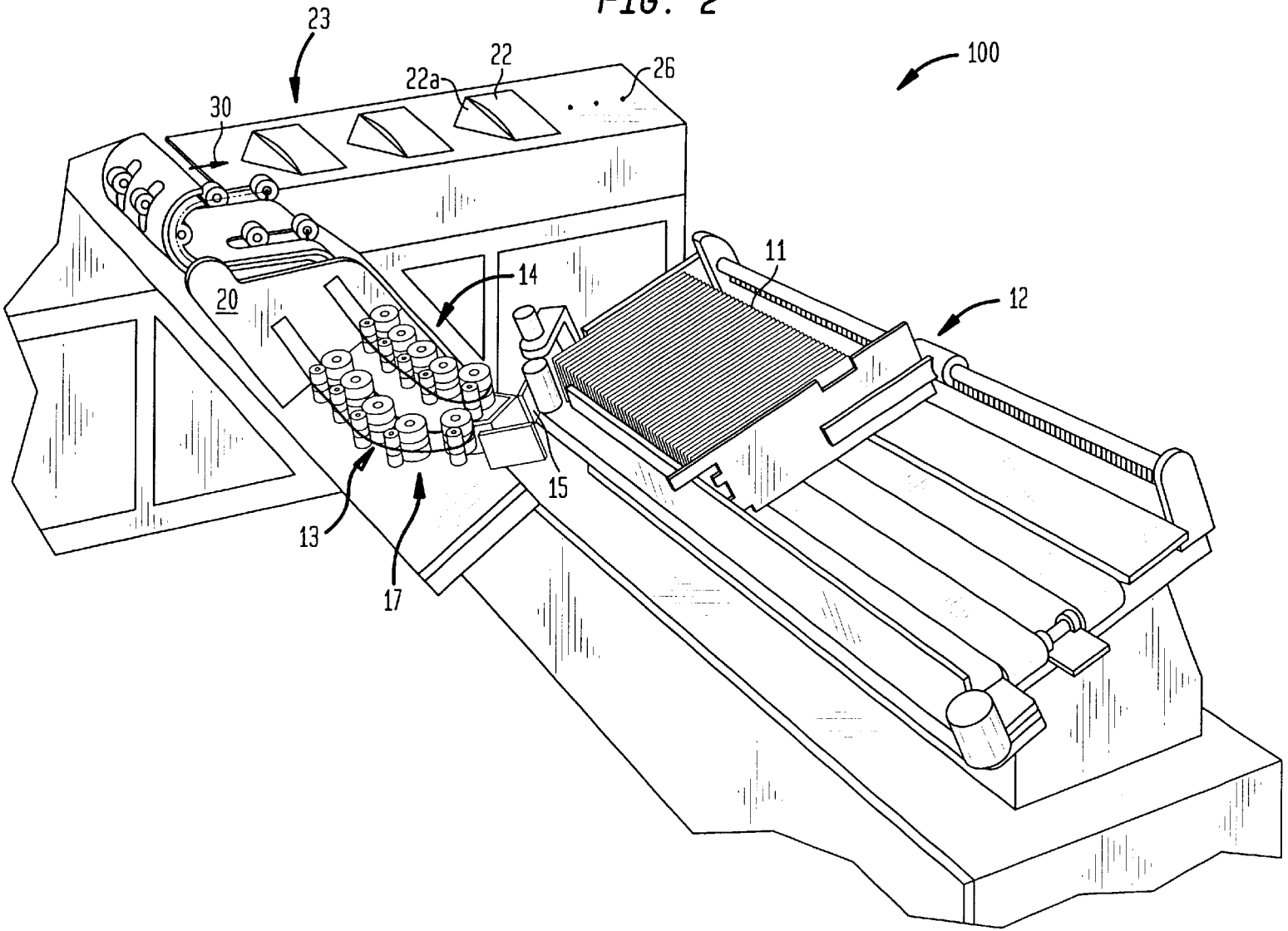
FIG. 2 is a perspective drawing of an envelope transport system according to the present invention depicted in FIG. 1.

In describing the preferred embodiment of the present invention, reference is made to the drawings, wherein there is seen in FIG. 1 a schematic of a typical document inserting system, generally designated 10, which implements the envelope insertion station 100 embodying the present invention envelope transport system. In the following description, numerous paper handling stations implemented in inserter system 10 are set forth to provide a thorough understanding of the operating environment of the present invention. However it will become apparent to one skilled in the art that the present invention may be practiced without the specific details in regards to each of these paper-handling stations.

As will be described in greater detail below system 10 preferably includes an input system 110 that feeds paper sheets from a paper web to an accumulating station that accumulates the sheets of paper in collation packets. Preferably, only a single sheet of a collation is coded (the control document), which coded information enables the control system 115 of inserter system 10 to control the processing of documents in the various stations of the mass mailing inserter system. The code can comprise a bar code, UPC code or the like.

Essentially, input system 110 feeds sheets in a paper path, as indicated by arrow "a," along what is commonly termed the "main deck" of inserter system 10. After sheets are accumulated into collations by input system 110, the collations are folded in folding station 112 and the folded collations are then conveyed to a transport station 114, preferably operative to perform buffering operations for maintaining a proper timing scheme for the processing of documents in inserting system 10.

Each sheet collation is fed from transport station 114 to insert feeder station 116. It is to be appreciated that a typical inserter system 10 includes a plurality of feeder stations, but for clarity of illustration only a single insert feeder 116 is shown. Insert feeder station 116 is operational to convey an insert (e.g., an advertisement) from a supply tray to the main deck of inserter system 10 so as to be nested with the aforesaid sheet collation being conveyed along the main deck. The sheet collation, along with the nested insert(s) are next conveyed into the envelope insertion station 100 that is operative to insert the collation into an envelope. The envelope is then preferably conveyed to postage station 120 that applies appropriate postage thereto. Finally, the envelope is preferably conveyed to sorting station 122 that sorts the envelopes in accordance with postal discount requirements.

As previously mentioned, inserter system 10 includes a control system 115 coupled to each modular component of inserter system 10, which control system 115 controls and harmonizes operation of the various modular components implemented in inserter system 10. Preferably, control system 115 uses an Optical Character Reader (OCR) for reading the code from each coded document. Such a control system is well known in the art and since it forms no part of the present invention, it is not described in detail in order not to obscure the present invention. Similarly, since none of the other above-mentioned modular components (namely: input system 110, folding station 112, transport station 114, insert feeder station 116, postage station 120 and sorting station 122) form no part of the present invention envelope insertion station 100, further discussion of each of these stations is also not described in detail in order not to obscure the present invention. Moreover, it is to be appreciated that the depicted embodiment of inserter system 10 implementing the present invention envelope insertion station 100 is only to be understood as an example configuration of such an inserter system 10. It is of course to be understood that such an inserter system may have many other configurations in accordance with a specific user's needs.

Referring now to FIGS. 2–5 the present invention envelope insertion station 100 is shown, which includes an envelope hopper 12, typically having a capacity of approximately 1500 envelopes, for feeding the envelopes 11 on preferably its flap-fold edge portion to either one or another of two parallel transport paths 13,14, each envelope 11 directed to one or another of the paths by a flipper gate 15. Each envelope is preferably propelled along the path to which it is directed by a series of nips 17, i.e. by the action of two turning, high-friction wheels disposed so as to be in mutual contact. Each pair of wheels forming a nip grabs (nips) an envelope and pulls it through the point of contact of the wheels at a linear velocity substantially equal to the angular velocity of either wheel, multiplied by its radius.

Both parallel transport paths 13,14 continue into a merge station 20, where an envelope in either path 13,14 is manipulated, as will be described below, so as to open its flap, and is then directed to a final, common path 30 of the envelope transport system, at ninety-degrees to the two parallel paths 13,14, and leading to a conveyor 23. Envelopes 22 on the conveyor 23 lie with their flaps open, as shown, and are conveyed to an insertion engine (not shown).

Figure 3:
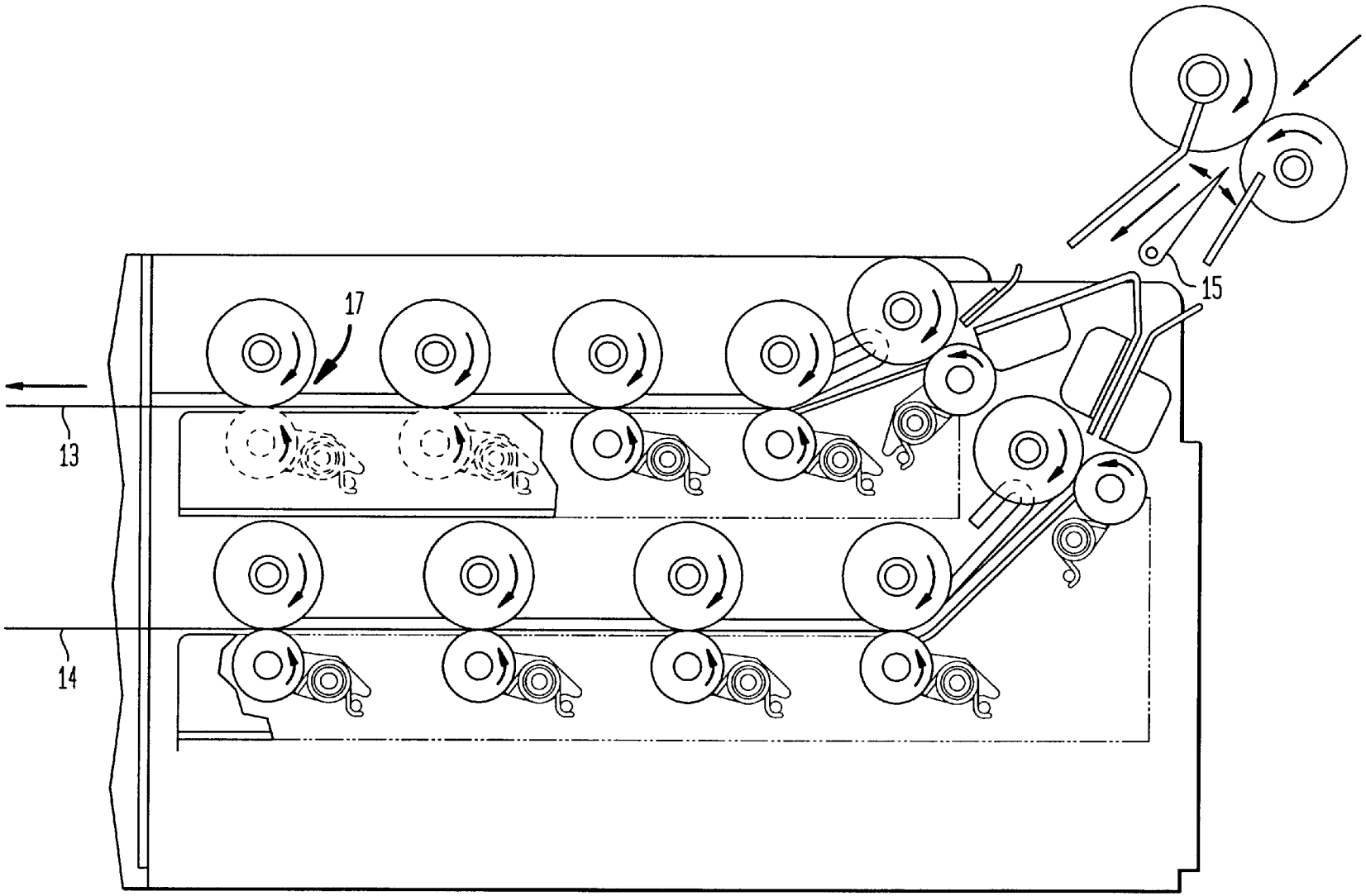
FIG. 3 is a detailed perspective drawing of part an envelope transport system according to the present invention, showing part of two parallel transport paths.
Figure 4:
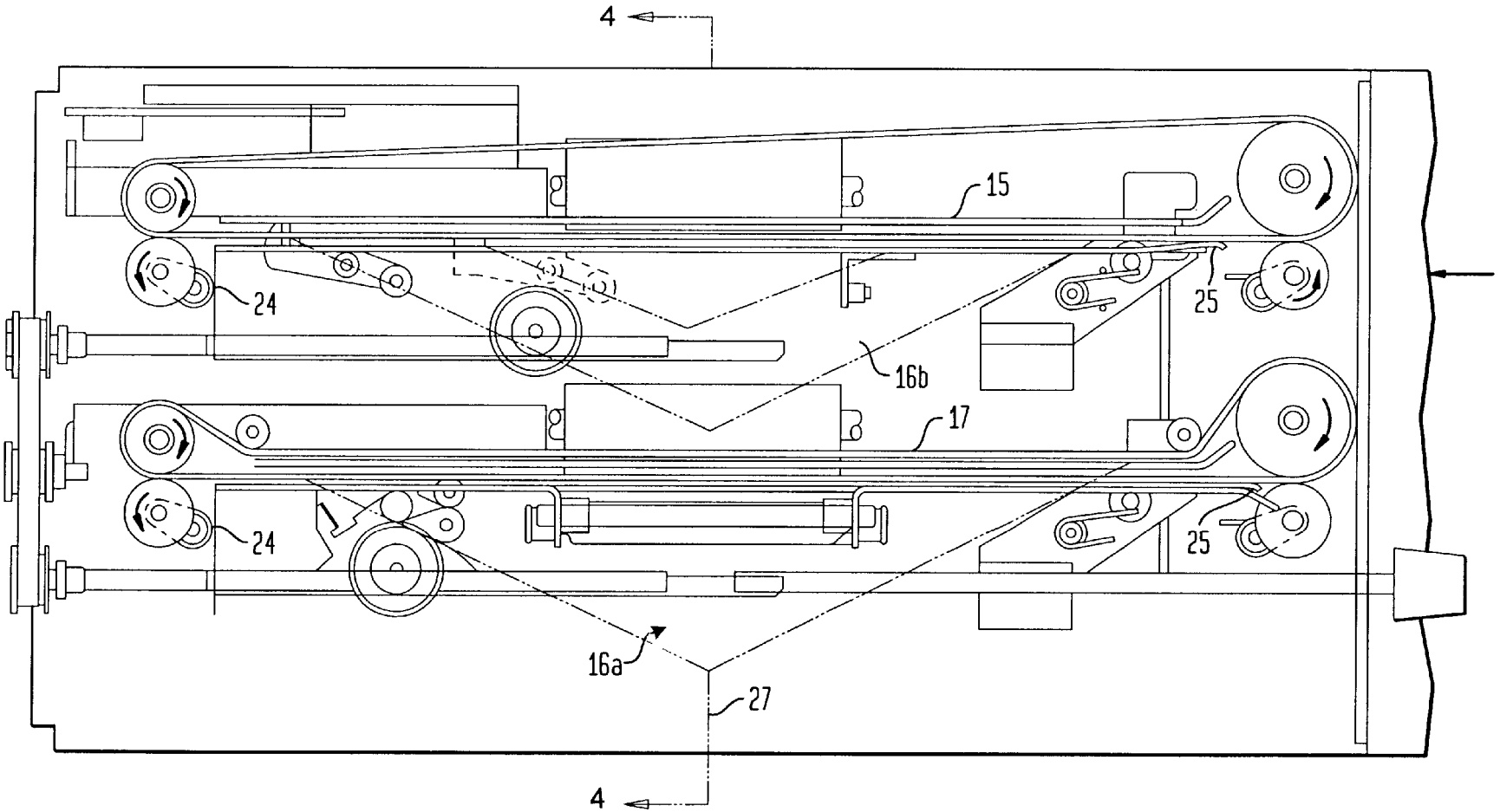
FIG. 4 is a detailed orthographic drawing of part an envelope transport system according to the present invention, showing a view of part of a merge station.
Figure 5:
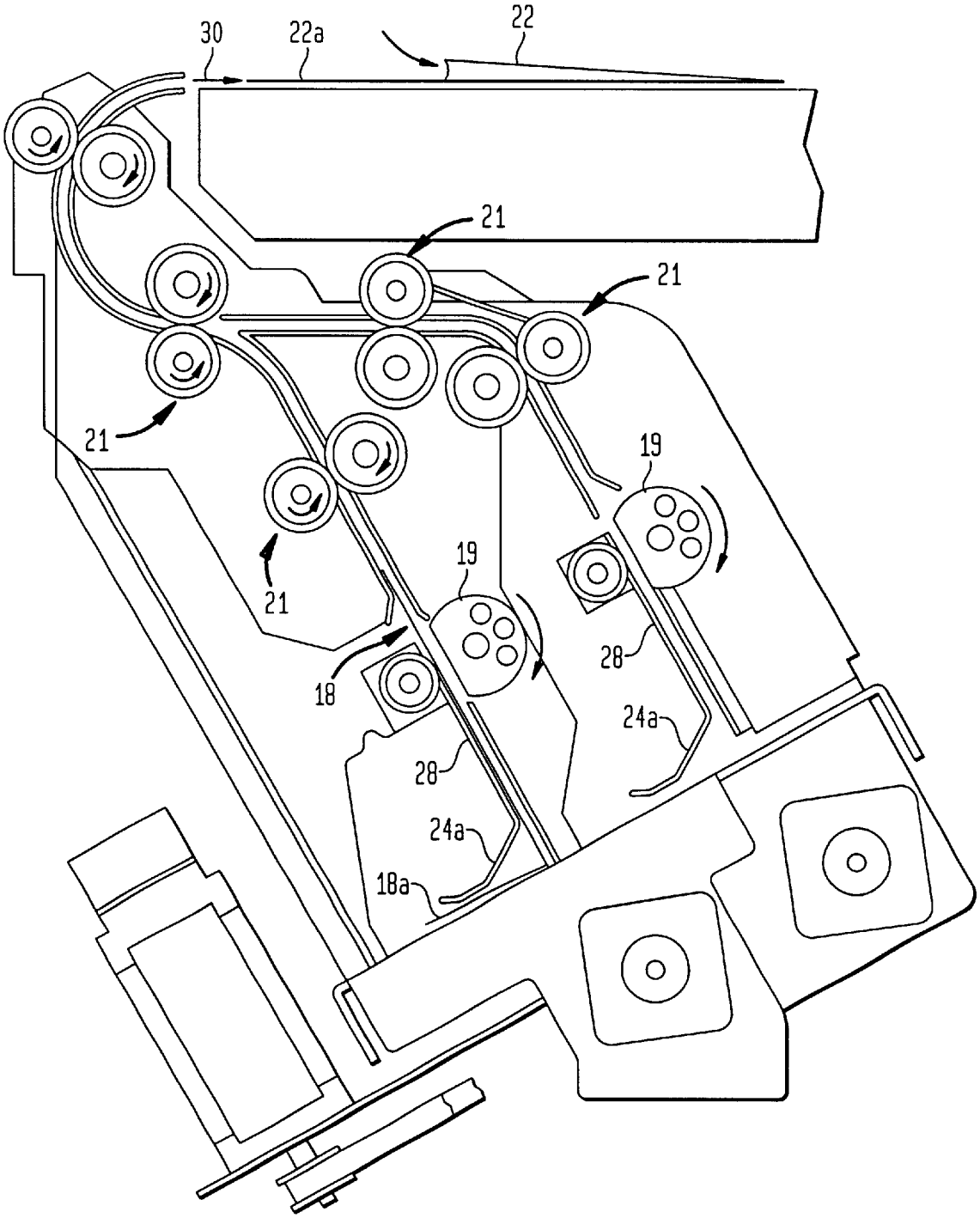
FIG. 5 is a detailed orthographic drawing of a view of the merge station called out in FIG. 4.

Referring now in particular to FIGS. 3 and 4, envelopes **16*a* and 16*b* in turn move into the merge station 20 (FIG. 1) until reaching an adjustable stop 24 provided in an holding area 15,17 respectively associated with each parallel transport path 13,14. The stops are accumulator-type stop and catch mechanisms, and are adjusted so that, depending on the size of the envelopes, the centerline 27 of an envelope in the merge station is aligned with the centerline 26 of the conveyor (see FIG. 1). As an envelope 18 is transported into the merge station 20, a conventional plow flap device 25 is used to plow open ninety degrees the flap 18*a*** of the envelope. Plowing open the flap of an envelope only ninety degrees allows the envelope to be crease-line justified.

Once inside the merge station, in response to a signal from an arming station (not shown) of the inserter system 10 (via its control system 15), the envelope is hoisted out of its parallel path 13,14 onto a final, common path 30, at preferably ninety degrees to the parallel transport paths 13,14, by the action of preferably a D-shaped roller 19, there being provided one such roller for each parallel transport path 13,14, and a combination of merge nips 21. During the hoisting motion, the flap of the envelope is opened the remaining 90 degrees, to full open, by arms **24*a* extending out from guides 28 for the parallel transport paths inside the merge station 20. The end result is that an envelope 22 is laid on the conveyor 23 with its flap 22*a* down and full open, and moving along the final, common path 30 on the conveyor 23** toward an inserter engine (not shown).

Of course it is possible that in some applications the parallel transport paths 13,14 do not continue always in a straight line to the merge station 20. Therefore, the redirection performed at the merge station 20, which is substantially ninety degrees, is to be understood as measured with respect to the direction of the parallel transport paths 13,14 at the point where they enter the merge station 20.

It is to be understood that the above-described arrangements are only illustrative of the application of the principles of the present invention. Numerous modifications and alternative arrangements may be devised by those skilled in the art without departing from the spirit and scope of the present invention, and the appended claims are intended to cover such modifications and arrangements.

What is claimed is:

1. A method for supplying envelopes to an inserter system, comprising the steps of:

providing an envelope supply structure having an exit point;

providing at least first and second supply paths from the exit point of the envelope supply structure;

providing a common path from the at least first and second supply paths;

feeding individual envelopes from the envelope supply structure to a selected one of the at least first and second supply paths;

conveying the envelope to a holding area in the selected supply path;

conveying the envelope from the holding area of the selected supply path to the common path; and conveying the envelope from the common path to an envelope insertion area wherein prearranged documents are caused to be inserted into the envelope.

2. A method for supplying envelopes to an inserter system as recited in claim 1 further comprising the step of:

stacking a plurality of envelopes in the envelope supply structure such that each envelope is stacked on an edge portion.

3. A method for supplying envelopes to an inserter system as recited in claim 2 further comprising the step of stacking each envelope on its flap fold edge portion such that the flap fold edge portion of each envelope resides against the supply structure.

4. A method for supplying envelopes to an inserter system as recited in claim 1 further including the steps of:

providing a diverting gate intermediate the exit point of the envelope supply structure and entry points to the at least first and second supply paths; and positioning the diverting gate in one of a first and second position so as to selectively cause the individual envelope to convey from the exit point of the envelope supply structure to the selected supply path.

5. A method for supplying envelopes to an inserter system as recited in claim 1 further including the steps of:

providing a flapping device in each one the first and second supply paths; and flapping open an envelope by engaging the envelopes flap fold edge portion with the flapping device located in one of the first and second supply paths.

6. A method for supplying envelopes to an inserter system as recited in claim 5 further including the step of opening the flap of the envelope by approximately 90° relative to the envelope's body in the selected supply path.

7. A method for supplying envelopes to an inserter system as recited in claim 6 further including the step of separating the flap of the envelope by an additional 90° as the envelope is caused to convey to the common path from the selected supply path such that the flap of the envelope is substantially co-planar with the envelope body.

8. A method for supplying envelopes to an inserter system as recited in claim 1 further including the step of:

changing an envelopes direction of travel by approximately 90° when the envelope is caused to convey from the holding area of the selected supply path to the common envelope path.

9. A method for supplying envelopes to an inserter system as recited in claim 1 further including the steps of:

causing first and second envelopes to be respectively positioned simultaneously in the holding area for each of the first and second envelope supply paths; and selectively causing an envelope to be conveyed from the holding area of one of the first and second supply paths to the common path.

10. A method for supplying envelopes to an inserter system, comprising the steps of:

providing an envelope supply structure having an exit point;

stacking a plurality of envelopes in the envelope supply structure such that each envelope is stacked on its flap fold edge portion;

providing first and second supply paths from the exit point of the envelope supply structure;

providing a diverting gate intermediate the exit point of the envelope supply structure and entry points to the first and second supply paths, the diverting gate being movable between first and second positions;

positioning the diverting gate in one of its first and second positions so as to selectively cause an individual envelope to convey from the exit point of the envelope supply structure to the selected supply path;

providing a common path from the at least first and second supply paths;

feeding individual envelopes from the envelope supply structure to a selected one of the at least first and second supply paths;

conveying the envelope to a holding area in the selected supply path;

conveying the envelope from the holding area of the selected supply path to the common path; and conveying the envelope from the common path to an envelope insertion area wherein prearranged documents are caused to be inserted into the envelope.

11. A method for supplying envelopes to an inserter system as recited in claim 10 further including the steps of:

providing a flapping device in each one the first and second supply paths; and flapping open an envelope by engaging the envelopes flap fold edge portion with the flapping device located in one of the first and second supply paths.

12. A method for supplying envelopes to an inserter system as recited in claim 11 further including the step of opening the flap of the envelope by approximately 90° relative to the envelope's body in the selected supply path.

13. A method for supplying envelopes to an inserter system as recited in claim 12 further including the step of separating the flap of the envelope by an additional 90° as the envelope is caused to convey to the common path from the selected supply path such that the flap of the envelope is substantially co-planar with the envelope body.

14. A method for supplying envelopes to an inserter system as recited in claim 11 further including the step of:

changing an envelopes direction of travel by approximately 90° when the envelope is caused to convey from the holding area of the selected supply path to the common envelope path.

15. A method for supplying envelopes to an inserter system as recited in claim 12 further including the steps of:

causing first and second envelopes to be respectively positioned simultaneously in the holding area for each of the first and second envelope supply paths; and selectively causing an envelope to be conveyed from the holding area of one of the first and second supply paths to the common path.

* * * * *